US005571259A

United States Patent [19]

Takasu

[11] Patent Number: 5,571,259

[45] Date of Patent: Nov. 5, 1996

[54] STRUCTURE OF WASHING MACHINE

[75] Inventor: Hiroyasu Takasu, Ohmiya, Japan

[73] Assignees: Robin & Leslie Co., Ltd., Taoyuan County, Taiwan; Kyowa Seisakusho Co., Ltd., Saitama-Pre, Japan

[21] Appl. No.: 407,080

[22] Filed: Mar. 20, 1995

[51] Int. Cl.[6] ..... F04B 17/00

[52] U.S. Cl. ..... 239/126; 239/127; 137/881

[58] Field of Search ..... 222/318, 424; 137/395, 397, 877, 878, 885, 881, 568; 239/124; 12/127, 126, 532, 525, 570, 583

[56] References Cited

U.S. PATENT DOCUMENTS

| | | | |
|---|---|---|---|
| 2,077,257 | 4/1937 | Ofeldt | 239/127 X |
| 3,140,049 | 7/1964 | Norstrund | 137/568 X |
| 3,491,948 | 1/1970 | Alexander | 239/127 |
| 3,760,982 | 9/1973 | Haase | 222/318 X |
| 4,460,127 | 7/1984 | Hoffman | 239/127 X |
| 5,259,556 | 11/1993 | Paige et al. | 239/124 |
| 5,397,054 | 3/1995 | Ziegs | 239/124 X |

*Primary Examiner*—Kevin Weldon
*Attorney, Agent, or Firm*—Bacon & Thomas

[57] ABSTRACT

A washing machine including a boiler, a motor-driven pump controlled by a control device to pump warm water from the boiler to a spray gun through a water supply pipe, a check valve installed in the water supply pipe, a water return pipe for sending water from the water supply pipe back to the boiler, an unload valve for releasing pressure from the water supply pipe, a water volume detector connected to the water supply pipe between the unload valve and the spray gun to accumulate water from the water supply piping and being actuated when accumulated water volume drops below a predetermined value, a pressure detector mounted on the unload valve and actuated when the unload valve is opened, and a control device driven by the water volume detector to start the motor when the water volume detector is actuated, or driven by the pressure detector to turn off the motor when the pressure detector is actuated.

3 Claims, 4 Drawing Sheets

STRUCTURE OF WASHING MACHINE

BACKGROUND OF THE INVENTION

1. Field of the Invention

The present invention relates to an improved structure of washing machine specially designed for washing motor vehicles, industrial machines, equipment of food and milk plants, etc. The washing machine greatly saves energy and is practical and durable in use.

2. Description of the Prior Art

FIG. 5 shows a washing machine for washing machines and industrial equipment according to the prior art. This washing machine comprises a boiler 10 connected to a water source and controlled to heat water to the desired temperature, a pump 20 driven by a motor 30 to pump warm water A1 from the boiler 10 to a water supply pipe 50, an unload valve 60 controlled to release water pressure from the water supply pipe 50, a spray gun 40 connected to the output terminal of the water supply pipe 50 and controlled by a lever **4*b*1 to eject warm water through a nozzle 4*a*1, and a water return pipe 70 for sending warm water A1 from the water supply pipe 50 back to the boiler 10 when the unload valve 60 is operated. This structure of washing machine has drawbacks. Because tile pump 20 and the motor 30 are kept operating during the operation of the washing machine, much energy is wasted and, the inside pressure of the water supply pipe 50 as well as the pump 20 will be increased rapidly when the spray gun 40 is stopped, causing the metal fittings of the water supply pipe 50 to wear quickly. Furthermore, because the motor 30** must be turned on/off by land, the working efficiency of the washing machine is low.

SUMMARY OF THE INVENTION

The present invention has been accomplished to provide a washing machine which eliminates the aforesaid drawbacks. This object is achieved by installing a check valve, a water volume detector, a pressure detector, and a control device. The check valve is installed in the water supply pipe between the unload valve and the pump and actuated when accumulated water volume drops below a predetermined value. The water volume detector is installed in the water supply pipe between the unload valve and the spray gun to accumulate water from the water supply pipe, and actuated when accumulated water volume drops below a predetermined value. The pressure detector is mounted on the unload valve and actuated when the unload valve is opened, The control device is driven by the water volume detector to start the motor when the water volume detector is actuated, or driven by the pressure detector to turn off the motor when the pressure detector is actuated.

DETAILED DESCRIPTION OF THE PREFERRED EMBODIMENT

Figure 1:
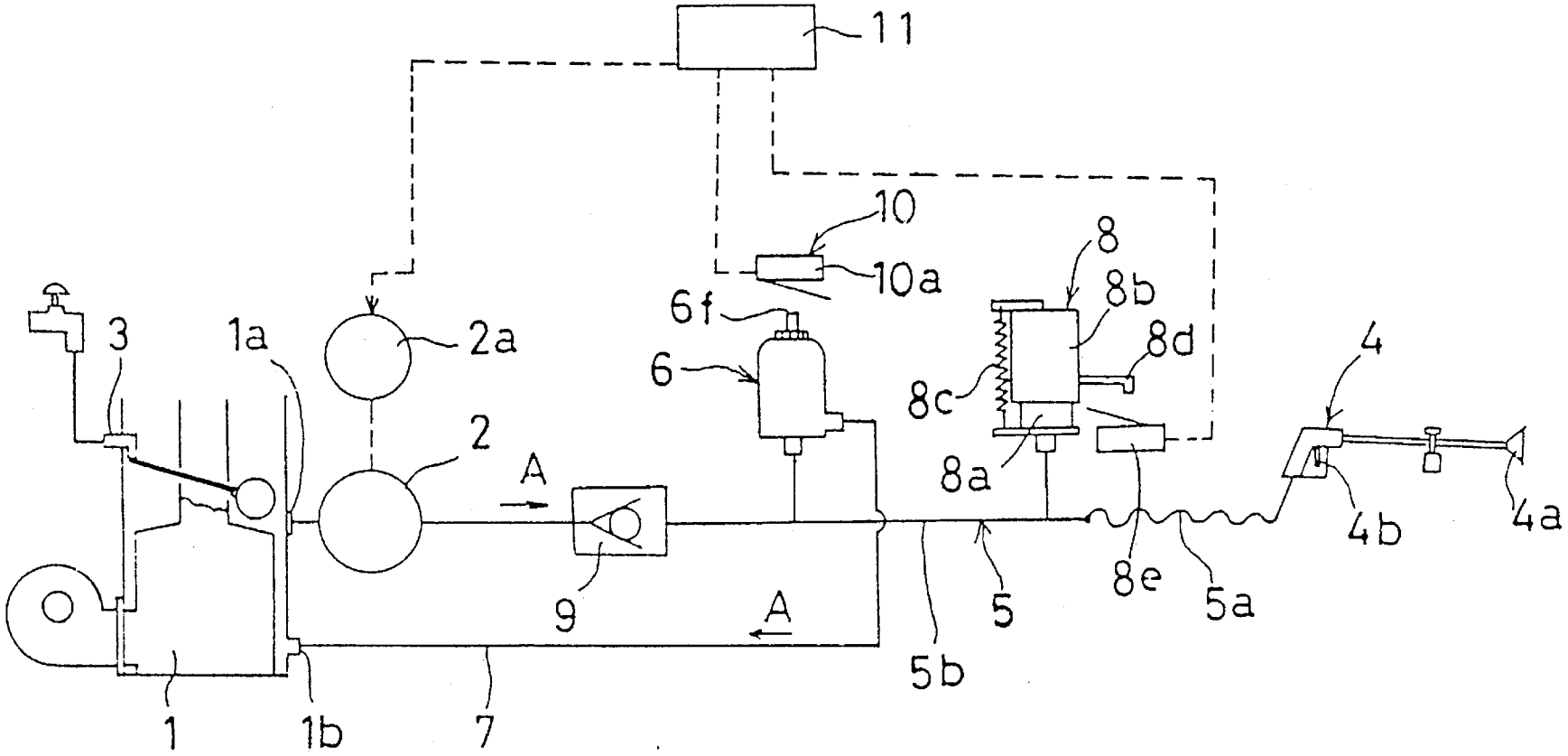
FIG. 1 shows the hardware arrangement of a washing machine according to the present invention.

Referring to FIG. 1, a washing machine according to the present invention comprises a boiler 1 connected to a water source (not shown) through a float valve 3 and controlled to heat water to the desired temperature and having a warm water outlet **1*a* and a return water inlet 1*b*, a pump 2 driven by a motor 2*a* to pump warm water A from the warm water outlet 1*a* of the boiler 1 to the fixed pipe 5*b* of a water supply piping 5, an unload valve 6 controlled to release water pressure from the water supply piping 5, a spray gun 4 connected to the hose 5*a* of the water supply piping 5 and controlled by a lever 4*b* to eject warm water through a nozzle 4*a*, and a water return pipe 7 for sending warm water A from the fixed water pipe 5*b* of the water supply piping 5 back to the boiler 1 through the return water inlet 1*b* when the unload valve 60 is operated. The washing machine further comprises a water volume detector 8, a check valve 9, a pressure detector 10, and a control device 11**.

Figure 2:
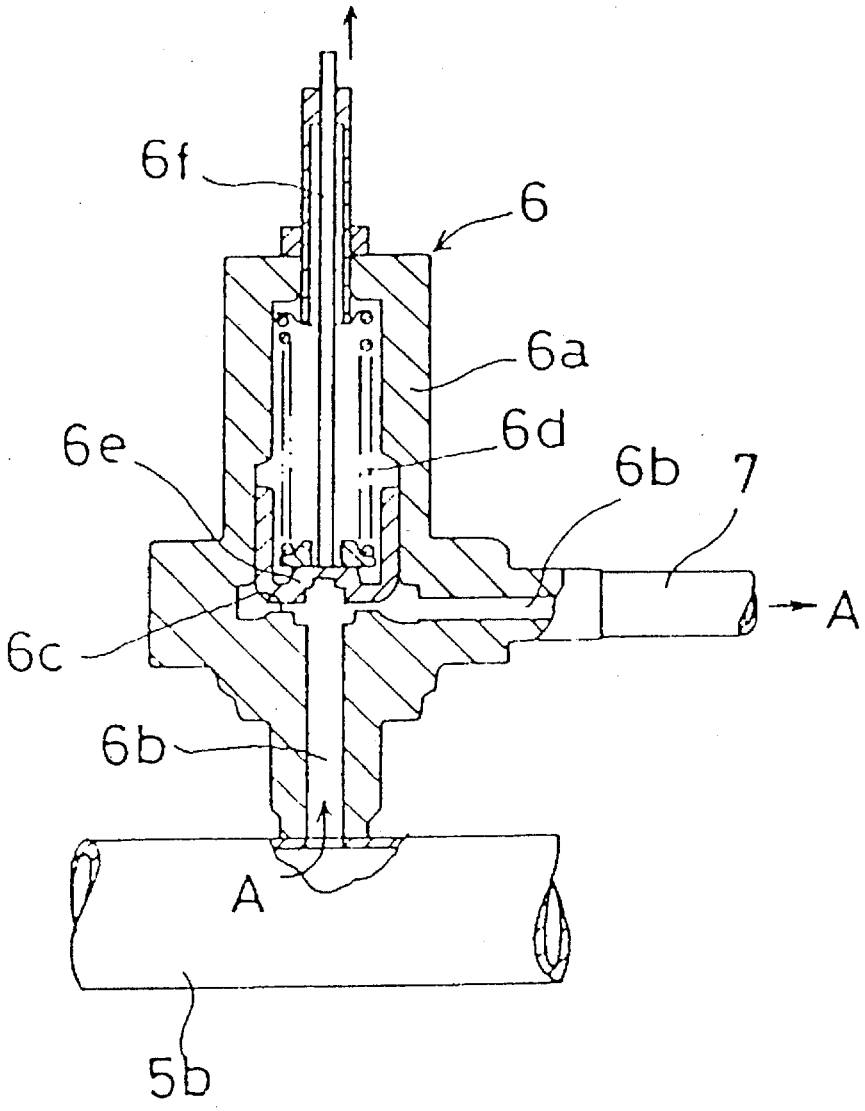
FIG. 2 is a longitudinal view in section of an unload valve according to the present invention.

Referring to FIG. 2, the unload valve 6 comprises a casing **6*a*, a substantially L-shaped water passage 6*b* defined within the casing 6*a* and connected between the water return pipe 7 and the fixed pipe 5*b* of the water supply piping 5, a valve seat 6*c* mounted at the angle of the L-shaped water passage 6*b*, a valve stem 6*f* having a top end extended out of the casing 6*a* and a bottom end fixed with a stem washer 6*e*, and a spring 6*d* mounted within the casing 6*a* and stopped against the stem washer 6*e*. The spring 6*d* gives a downward pressure to the stem washer 6*e*, causing the step washer 6*e* to seal the valve seat 6*c*, and therefore warm water is prohibited from passing from the fixed pipe 5*b* to the water return pipe 7**.

Figure 3:
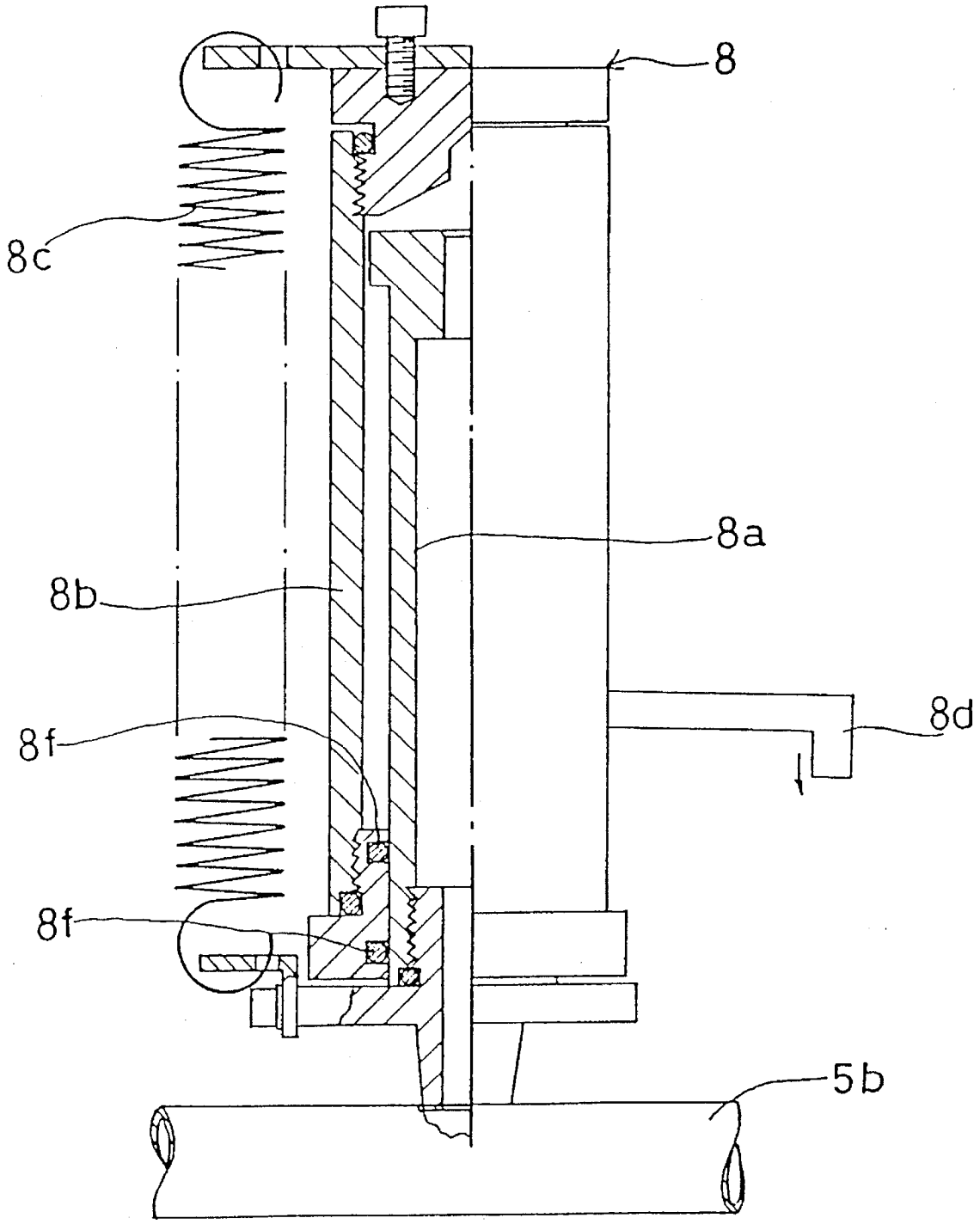
FIG. 3 is a longitudinal view in section of a water volume detector according to the present invention.

Referring to FIG. 3, the water volume detector 8 comprises a first water container **8*a* of cylindrical shape having a bottom end connected to the fixed pipe 5*b*, a second water container 8*b* suspended around the first water container 8*a* and moved vertically relative to the first water container 8*a* subject to the volume of water accumulated in the first water container 8*a*, a suspension spring 8*c* having one end fixed to the top side of the second container 8*b* and an opposite end fixed to the bottom side of the first water container 8*a*, a pressure board 8*d* connected to the periphery of the second water container 8*b*, a limit switch, namely, the first limit switch 8*e* (not shown) mounted below the pressure board 8*d*. When the pressure board 8*d* is lowered by the second water container 8*b* to touch the first limit switch 8*e*, the first limit switch 8*e* is triggered. Further more, reference number 8*f*** indicates packing rings.

Referring to FIG. 1 again, the check valve 9 is mounted in the fixed pipe **5*b* of the water supply piping 5 at a location between the pump 2 and the connecting point between the unload valve 6 and the fixed pipe 5*b***, to prohibit reverse flow of warm water.

Figure 4:
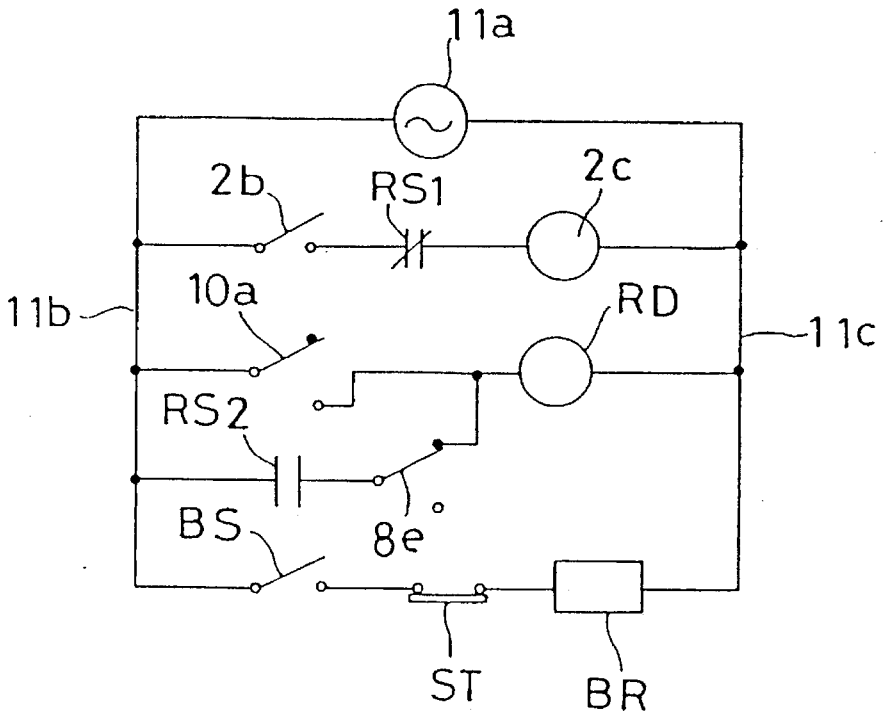
FIG. 4 is a circuit diagram of the control device for the washing machine according to the present invention.
Figure 5:
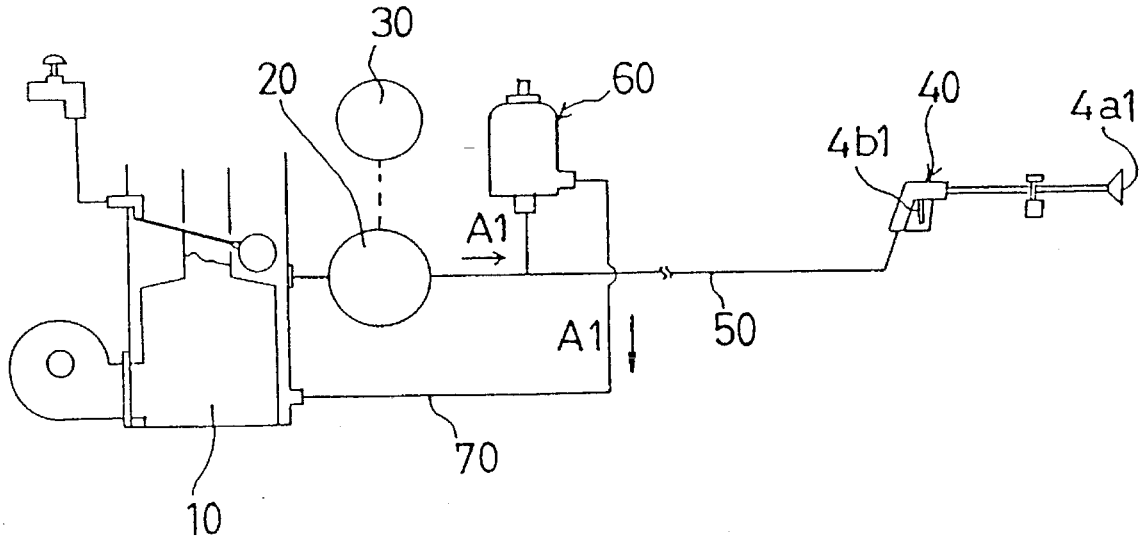
FIG. 5 shows the hardware arrangement of a washing machine according to the prior art.

Referring to FIG. 4, the control device 11 is connected between the positive and negative lines **11*b* and 11*c* of the power supply 11*a*. The pump switch 2*b*, the normal close switch RS1 (the contact b of the relay), and the magnetic switch 2*c* are connected in series into a loop. The first limit switch 8*e* is connected in series to the normal open switch RS2 (the contact a of the relay), and then connected in parallel to the second limit switch 10*a***, and then connected in series to the coil RD (of the relay) for form a loop. The burner switch BS, the thermalstate ST, and the burner control relay BR are connected in series into a loop.

Referring to FIGS. 1 and 4 again, when the burner switch BS is switched on, the boiler 1 is turned on to heat water A, then the pump switch 2*b* is switched on to turn on the motor 2*a*, causing the pump 2 to pump warm water from the warm water outlet 1*a* to the water supply pipe 5, and therefore warm water is ejected out of the nozzle 4*a* when the spray gun 4 is opened by the lever 4*b*. At the same time, the first water container 8*a* starts to accumulate water, causing the second water container 8*b* to move upwards to the set position. When the spray gun 4 is stopped by the lever 4*b*, the water passage between the check valve 9 and the spray gun 4 is enclosed, causing the inside pressure of the water supply piping 5 increased, and therefore the unload valve 6 is forced open to release pressure out of the water supply piping 5. When the unload valve 6 is opened, the second limit switch 10*a* is triggered to turn on the coil RD, causing the normal open switch RS2 closed, and at the same time the normal close switch RS1 is opened to turn off the magnetic switch 2*c*, and therefore the motor 2*a* is stopped and the pump 2 does no work. At this stage, a part of warm water A passes from the fixed pipe 5*b* through the water passage 6*b* of the unload valve 6 to the boiler 1 through the water return pipe 7. When the inside pressure 5 of the water supply pipe 5 drops to such a range below the spring force of the spring 6*a*, the spring 6*a* automatically forces the stem washer 6*e* to close the valve seat 6*c* again, and therefore the unload valve 6 is closed. When the spray gun 4 is opened again to let warm water A flow from the water volume detector 8 and the water supply piping 5 out of the nozzle 4*a* through the spray gun 4, the second water container 8*b* is forced downwards by the spring 8*c*, and the pressure board 8*d* is lowered to trigger the first limit switch 8*e*, causing the coil RD disenergized, and therefore the normal close switch RS1 is closed again, and the magnetic switch 2*c* is switched on to turn on the motor 2*a* and the pump 2.

As indicated, the motor 2*a* and the pump 2 are turned on/off by means of controlling the lever 4*b* of the spray gun 4, i.e., the motor 2*a* and the pump 2 are turned off when the spray gun 4 is closed, or turned on when the spray gun 4 is opened.

What is claimed is:

1. A washing machine of the type comprising a boiler connected to a water source through a float valve and controlled to heat water to the desired temperature, a pump driven by a motor to pump warm water from said boiler to a water supply piping, an unload valve controlled to release water pressure from said water supply piping, a spray gun connected to said water supply piping and controlled by a lever to eject warm water through a nozzle, and a water return pipe for sending warm water from said water supply piping back to said boiler when said unload valve is opened to release pressure, the improvement comprising:

a water volume detector connected to said water supply piping between said unload valve and said spray gun to accumulate water from said water supply piping, said water volume detector being actuated when accumulated water volume drops below a predetermined value;

a pressure detector mounted on said unload valve, said pressure detector being actuated when said unload valve is opened; and a control device to control the operation of said motor, said control device being driven by said water volume detector to start said motor when said water volume detector is actuated, or driven by said pressure detector to turn off said motor when said pressure detector is actuated.

2. The washing machine of claim 1 wherein said water volume detector comprises a first water container connected to said water supply piping to accumulate water from said water supply piping, a second water container suspended around said first water container and moved vertically relative to said first water container subject to the volume of water accumulated in said first water container, a spring means connected between said first water container and said second water container to give a downward pressure to said second water container, and a limit switch, said limit switch being triggered to drive said control device when said second water container is moved downwards relative to said first water container.

3. The washing machine of claim 1 wherein said pressure detector comprises a micro switch which is switched on to drive said control device when said unload valve is opened.

* * * * *